United States Patent [19]

Weir et al.

[11] Patent Number: 4,661,247

[45] Date of Patent: Apr. 28, 1987

[54] MODULAR OPERATIONS CENTER FOR IN-GROUND SWIMMING POOL

[75] Inventors: Donald H. Weir, York, Pa.; Stanley H. Frederick, Sanford, N.C.; Robert A. Hotaling, York, Pa.; Ronald B. Robol, Sanford, N.C.

[73] Assignee: Fox Industries Incorporated, York, Pa.

[21] Appl. No.: 826,637

[22] Filed: Feb. 6, 1986

[51] Int. Cl.[4] ..... B01D 29/06; B01D 29/08; B01D 29/24

[52] U.S. Cl. ..... 210/97; 210/169; 210/196; 210/197; 210/416.2

[58] Field of Search ..... 210/169, 194, 195.1, 210/196, 197, 416.2, 104.97

[56] References Cited

U.S. PATENT DOCUMENTS

| | | | |
|---|---|---|---|
| 3,024,470 | 3/1962 | Baker | 4/172 |
| 3,317,925 | 5/1967 | Vance | 4/172 |
| 3,596,296 | 8/1971 | Gertz et al. | 4/172 |
| 3,811,137 | 5/1974 | Schankler | 4/172 |
| 3,820,173 | 6/1974 | Weller | 4/172 |
| 3,829,911 | 8/1974 | Bishop | 4/172 |
| 3,895,402 | 7/1975 | Page | 4/172 |
| 4,233,694 | 11/1980 | Janosko et al. | 4/542 |
| 4,240,174 | 12/1980 | Thiem et al. | 15/1.7 |
| 4,330,412 | 5/1982 | Frederick | 210/805 |
| 4,421,643 | 12/1983 | Frederick | 210/138 |
| 4,555,334 | 11/1985 | Cohen | 210/169 |
| 4,564,451 | 1/1986 | Cohen | 210/169 |

OTHER PUBLICATIONS

French Publication on, "Do It Yourself Pool", reported by Jean Calmus, pp. 49–61, publication and date unknown (with translation).

*Primary Examiner*—Frank Sever

*Attorney, Agent, or Firm*—Arthur J. Plantamura

[57] ABSTRACT

A modular prefabricated filter/circulating system for in-ground swimming pools is provided. The swimming pool circulation system which serves to filter and circulate pool water is designed to be prefabricated at the factory and carried to the swimming pool site as a package and installed on the swimming pool wall so that one side wall of the prefabricated package becomes an integral part of the swimming pool wall. The system is provided with a skimmer with streamlined faceplate, main drain, skimmer filter, main drain filter, skimmer throttle valve, quick connect from filter to pump and return, pump, automatic safety pump shutoff, high efficiency pool returns and automatic pool sweep pressure increase mechanism. The system is designed to avoid conventional piping and trenches therefor normally associated with conventional swimming pool filtration systems. The system affords substantial energy saving and is more reliable and safer. A distinct element employed in a preferred embodiment resides in a two-compartment filter unit that extends operating life by permitting the function of the first compartment filtration to be transferred to the other compartment when the first compartment is clogged.

19 Claims, 7 Drawing Figures

MODULAR OPERATIONS CENTER FOR IN-GROUND SWIMMING POOL

The invention relates to improved in-ground swimming pool construction. More particularly, the invention relates to a modular unit which may be prefabricated and comprise a part of the swimming pool peripheral wall and which contains therein essentially the entire filtration/circulatory function, lighting, sanitizing system with provisions for integral heating unit(s) for the swimming pool and preferably incorporates a two-compartment filter unit.

BACKGROUND OF THE INVENTION

At the present time, swimming pools generally require a complex array of plumbing and electrical components to provide filtration of the pool water. For example, a typical pool consists of a skimmer, main drain, suction piping and valves to connect suction to a pump. The pump discharge is connected to a pressure vessel type filter. The filter is then connected back to the pool through discharge piping. A typical plumbing system also has 30 to 40 feet of suction piping with numerous elbows and fittings. The discharge piping may consist of 50 to 70 feet of discharge piping to return the filtered water to the pool. The usual practice is to locate the filter and pump at a remote location away from the pool wall and above ground level. The complex array of plumbing is typically done at the job site with hand tools. Many times the plumbing is done with little knowledge of hydraulics and consequently many systems perform poorly and cause pool owners numerous problems. The plumbing system of piping is typically buried in trenches which must be dug from the pool walls to the filter pump site. In addition to the work required to install this complicated system of piping, elbows, valves, fittings, etc. one normally has to overcome relatively high total dynamic head. The high dynamic head causes a substantial loss of "flow" which is needed to filter the pool water properly. This causes the installer to use a much larger pump and motor which consumes considerable power. It is thus apparent that a need exists for a unit which is capable of being prefabricated and brought to the swimming pool site and installed in place, and which may be a part of the swimming pool wall, without the extra expense and cumbersome task of using relatively extensive lengths of piping and building an array of discharge and return trenches and without the need to install numerous other relatively labor intensive plumbing, electrical and mechanical elements.

SUMMARY OF THE INVENTION

It is a primary object of the present invention to provide a modular unit for swimming pools which contains essentially the entire operations of a swimming pool functioning system and avoids the need for extensive piping normally associated with swimming pool water circulatory systems and for the construction of trenches to accommodate such piping.

It is further object of the invention to provide a prefabricated modular unit which comprises a part of the swimming pool wall and may be constructed off-site and then brought to the swimming pool construction site and installed contiguous to or, preferably, as a part of the swimming pool wall and contains therein the essential filtering and circulating capability for the swimming pool.

It is another object of the invention to provide a modular unit which is delivered assembled to the swimming pool site and becomes part of the pool wall and contains filter, skimmer, valves, plumbing, chlorinator, lighting, optional swim jets and heater unit(s) and pool return systems.

It is another object of the invention to provide an improved swimming pool system which, by its design, will have a relatively low friction drop in its water circulatory arrangement such that it will provide the necessary flow with a relatively smaller pump.

It is a further object to provide a swimming pool circulatory system which can be pre-plumbed and hydrostatically and electrically tested in a factory setting such that the only field connections needed would be to install the main drain, to connect the pump package to the filter package using quick connect couplers, and to plug the pump package into an outdoor electrical outlet.

It is still another object of the invention to provide on the modular filtration/circulatory unit a skimmer designed with a hydraulically streamlined skimmer inlet which reduces low resistance to water flow going into the skimmer and, optionally, permits efficient use of the existing type skimmer faceplate and is compatible with the use of a sand or diatomacous earth filter media.

It is another object of the invention to provide a compact efficient filter housing which is divided into two compartments, one of which is a vacuum chamber that draws water from the pool's main drain, also provides a means by which a pool may be vacuumed with a manual attachment and the second chamber is a relatively minimal chamber that draws from the skimmer.

A further object of the invention resides in the provision of a two compartment design filter arrangement which permits a longer filter cycle between cleaning wherein the skimmer element takes over the function of the main drain filter element when the main drain filter element becomes blocked.

It is another object of the invention to provide a modular unit having a suction filtration system that requires less servicing of the pump than a normal system because larger particles cannot get through to the pump and destroy both the impeller and the mechanical seal due to the fact that filtration on the suction side of the pump will allow only relatively small particles of predetermined maximum size, that are far less detrimental to the pump, to get to the pump and consequently will not cause a deterioration of the pump and associated parts. Optionally, the system permits functioning by pressure filtration, with sand or diatomacious earth or with cartridge type filter media.

It is still a further object of the invention to provide a mdoular circulatory/filtration unit for swimming pools with water circulatory system returns designed to be permanently oriented with respect to the pool wall so as to provide optimum water circulation for better mixing of the chemicals in the water and better filtration.

Still a further object of the invention resides in providing a modular swimming pool circulation system having optimum performance return fittings that direct the water flow in a predetermined angle to the pool wall.

Another object of the invention is the provision of a circulatory arrangement for swimming pools designed with a low hydraulic resistance that reduces the system friction curve and lowers the horsepower required to operate with standard relatively high resistance returns.

Another object of the invention resides in a swimming pool modular circulatory system designed with an automatic safety shutoff having a vacuum switch connected to the vacuum side of the filter and set at a suitable vacuum level so that if the filter becomes clogged and/or if the main drain is blocked by trash or other object, such as the body of a child, the pump would shut off.

It is another object of the invention to provide a swimming pool circulatory system designed so that when an automatic pool sweep is connected to the system, it will nominally reduce the flow through the filtration/circulatory elements of the module and increase the actuation pressure needed to propel the pool sweep.

It is a further object of the invention to provide an improved swimming pool filtration and circulatory system which is generally compact; is modular in design so that it is convenient to prefabricate off site such as in a factory setting; uses less material; and economizes substantially both in materials and installation labor, as compared to prior art systems.

It is another and specific object of the invention to provide an improved swimming pool filtration and circulatory system which integrates an efficient chlorination system.

It is another and particular object of the invention to provide an improved swimming pool filtration and circulatory system modular unit which optionally will allow (include) a very high flow swim jet component to be used in an exercise zone, whereby a swimmer can swim against the current induced and would be able to vary the intensity of the flow component without the need for additional plumbing, etc., currently necessary to accommodate such a device.

It is still a further object of the invention to provide an improved swimming pool filtration and circulatory modular unit that optionally allows for the integration into the modular unit of an underwater lighting capability of a kind usually associated with a swimming pool but which eliminates the usually high cost associated with the installation of the usual electrical lines, junctions, etc.

It is another and particular object of the invention to provide an improved swimming pool filtration and circulatory modular unit in which a heat exchange source may be integrated much more efficiently than prior art systems thus decreasing the energy required to heat the pool.

Additional objects and advantages of the invention will become apparent from the drawing and the detailed description of the invention provided hereinbelow.

DETAILED DESCRIPTION OF THE INVENTION

Figure 1:
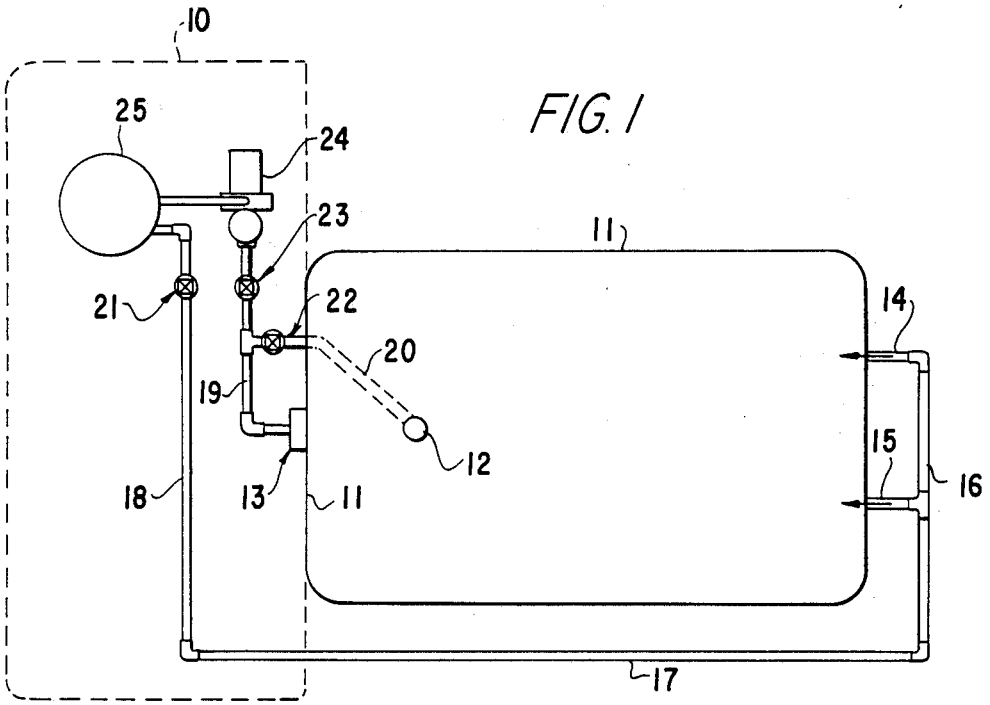
FIG. 1 is a schematic diagram illustrating by plan view a swimming pool equipped with a typical water circulating and filtration system of the kind that is used in the prior art to service a swimming pool.

Referring to the drawings, a conventional swimming pool arrangement is illustrated by FIG. 1; the arrangement comprises generally the pool whose peripheral rectangular wall is shown at 11 and a circulation and filtration system, the several parts of which are encompassed within the area of the broken line 10, is situated contiguous to one end of the pool 11. This system employs a relatively complex array of plumbing and electrical components to provide suitable filtration for the pool. Typically, the plumbing accessories include at least a main drain 12 which draws water and sediment from the bottom of the swimming pool and a skimmer 13 through which water to be filtered and recirculated is withdrawn and debris is removed. In the circulation process, water withdrawn from the pool through the main drain and from the skimmer is filtered and optionally chemically treated and returned to the swimming pool through returns such as shown at 14 and 15 normally situated at a suitable distance, frequently at the opposite end of the swimming pool, from the position of the skimmer 13 for the intended purpose of enhancing circulation. Water withdrawn from the swimming pool, utilizing a suitable pump 24, is filtered at 25 and through use of appropriate valves such as 21, 22 and 23, is reintroduced into the swimming pool at return points such as those illustrated at 14 and 15. In systems of this kind, even relatively small pools will require some 30 to 40 feet of suction piping some of which is illustrated at 19 and 20, as well as the use of various pipe elbows and fittings, and some 50 to 70 of discharge piping, as shown at 16, 17 and 18, to return the filtered water to the swimming pool. In constructing below-ground swimming pools, the current practice generally is to consider the filtration and circulation system for the swimming pool as a separate and distinct entity and this facility, in the main, is treated as a separate installation operation. It is normally the practice to locate the filter 25 and pump 24 at a location removed from the pool wall 22 and above ground level. The piping referred to at 16, 17 and 18 is typically buried in a trench which must be dug from the pool location to the filter and pump site. The installation of the relatively complex array of plumbing of the kind shown in FIG. 1 is typically done at the job site usually with hand tools, a task which is relatively labor intensive and comprises a substantial cost factor to be borne by the pool owner. Additionally, the plumbing is often done by workers who lack adequate experience and with insufficient knowledge of the proper hydraulics; consequently, the resulting plumbing systems perform unsatisfactorily and gives rise to problems for the swimming pool owners.

Figure 2:
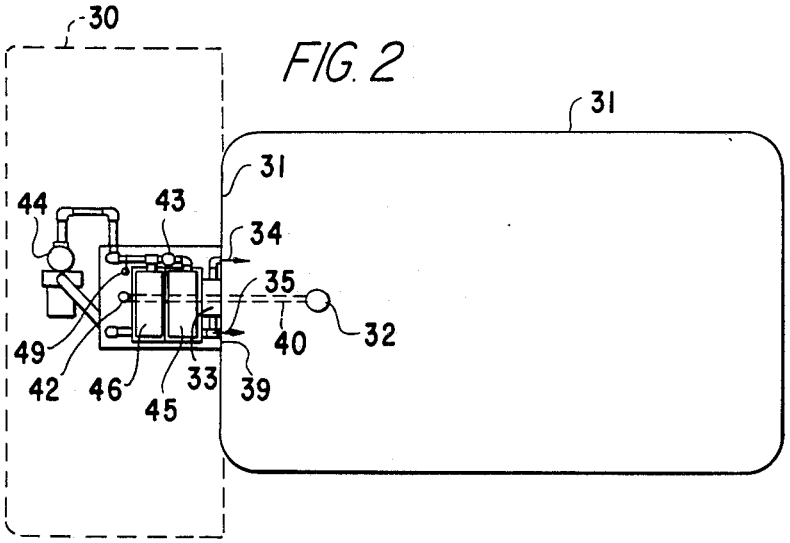
FIG. 2 is a schematic diagram illustrating also by plan view a swimming pool and in conjunction therewith a typical installation at the swimming pool wall of the water circulating and filtration modular system of the invention.

According to the invention, a novel system is provided which substantially obviates the complexity of parts and arrangement and the extensive labor and expense typically associated with a properly installed filtration and circulatory system for swimming pools. As shown by reference to FIG. 2 of the drawing, the improvement of the invention is illustrated diagrammatically. The filtration and circulation (pumping) system encompassed with the area 30 of the broken line of FIG. 2 comprises a module (the essential elements of which are shown in greater detail in FIG. 3) that is fitted into and, after installation, it may comprise an integral segment 39 of the swimming pool wall 31. The module 30 is so arranged and constructed that it may be entirely factory prefabricated and plumbed. The module 30 includes a side wall 39 which is substantially planar and can comprise a segment of the pool wall 31 when the module 30 is installed and becomes an integrated component of the swimming pool facility.

Incorporated in the module 30 is a skimmer opening 33, a filter arrangement preferably having a dual function filter, i.e. a separate skimmer filter 45 and a main drain filter 46, a pump 44 which is coupled to a suitable motor, preferably a two-speed motor, and suitable related valves and elements. Included among the latter, for example, are a main drain valve 42, a skimmer throttle valve 43, and such elements as a quick connect coupler from filter to pump and return and an automatic safety pump shut off 56, pool sweep connector 62, chlorinator reservoir and feed 49, and the like. These components are well integrated into the module 30 and housed in a prefabricated package with one side of the package comprising a segment 39 of the swimming pool wall which contains the skimmer opening with faceplate, preferably of a kind that promotes streamline flow of water from the pool through the skimmer opening 33.

Figure 3:
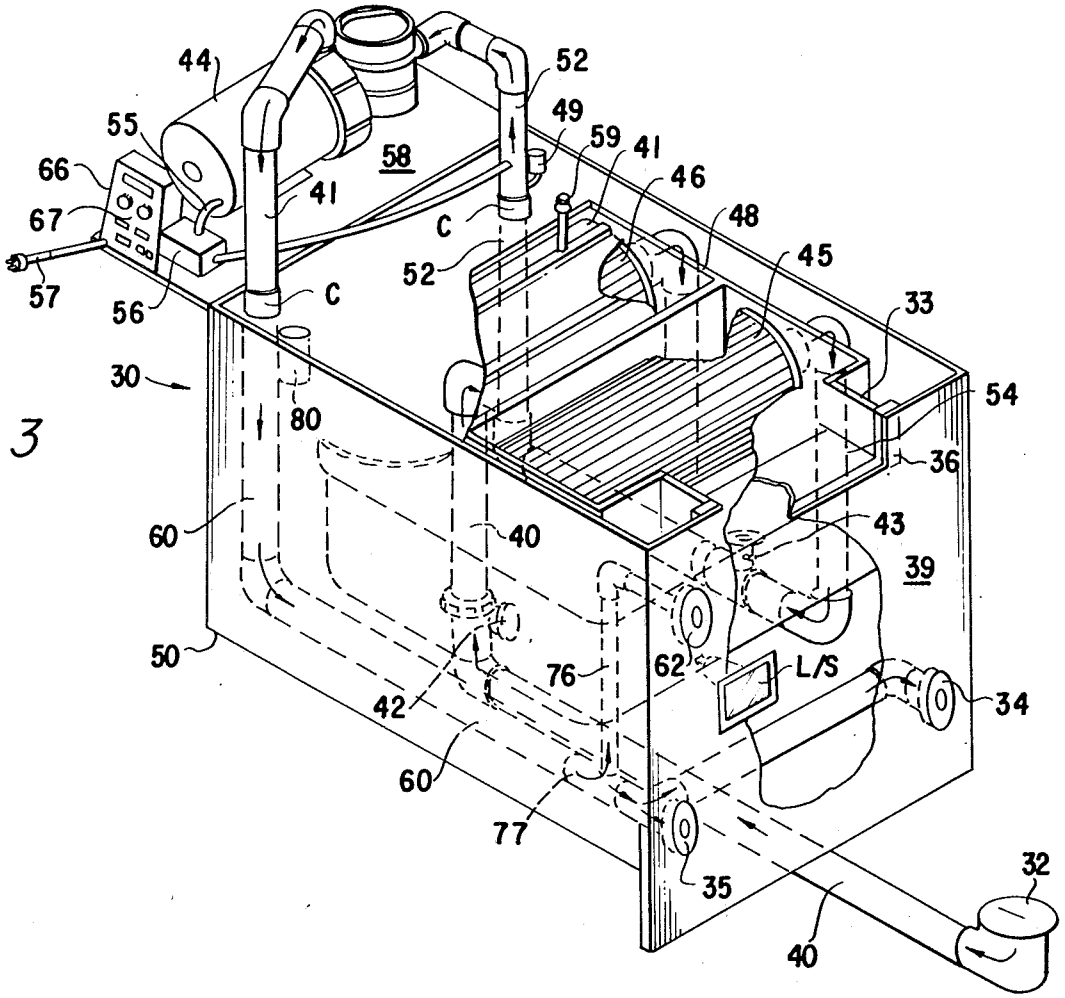
FIG. 3 is a perspective view showing in enlarged detail the swimming pool water circulating and filtration modular unit of the invention.

Referring in particular to FIG. 3, the several components of the filtering and circulating modular unit 30 of the invention are illustrated in greater detail. As shown, the filter arrangement which, as a preferred embodiment, comprises a two-compartment filtration unit that incorporates a skimmer filter 45 and a main drain filter 46, and is contained in the modular package housing 50 together with various associated components hereinafter described. A lid or closure for the filter container is shown at 63. The container package 50 contains, additionally, the interconnecting piping which leads from the maindrain piping leading from the exterior of the package 50 through valve 42 into the filter 46 and connecting pipe 52 which draws the filtered water through pump 44. Pipe 52 also draws water through the skimmer opening 54, skimmer filter 45 under suction from pump 44. The pump and motor shown for convenience as a single entity 44 has related electrical elements including the power line 55 and has a vacuum switch 56, in the event a vacuum buildup over a predetermined safety limit occurs, and line 57, leading to an external power source, are mounted on plate 58 so as to be conveniently accessible for monitoring or servicing at the top of the container package 50. Also contained in the container package 50 is the exit line 60 from pump 44 which furnishes the return water supply to returns 34 and 35 as well as, optionally, for powering the pool sweep mechanism (not shown) which is connected at 62.

The vacuum side of the unit includes also provision for attachment of a hand-held vacuum type pool cleaner. Provision of this kind is located at a point in the system that draws substantial vacuum such as by means of a quick disconnect coupler 59 suitably located to draw vacuum through the cover of the main drain filter unit 46.

For convenience in facilitating servicing, the unit may be provided with quick disconnect couplers at various locations where dismantling of parts would be desirable such as those shown at C on the intake pipe 52 and on the discharge pipe 60.

A heater unit 80 may also be container in the module 30 and located at a suitable location such as shown by connecting it to the discharge pipe 60.

A light fixture of a conventional commercial available type used for swimming pools may be positioned in the package 50 at a suitable point as shown at L/S on the wall panel 39 which will optimize the lighting effect for the swimming pool. Optionally, a "swim jet" accessory may be substituted, in lieu of the light, or provision made to incorporate an accessory of this kind in addition to the light, and located at L/S. A swim jet is essentially a self-contained device with a water intake and discharge that simulates a surf (current) condition which provides water resistance to a swimmer. One unit of this kind, which is provided with a pair of adjustable nozzles and pneumatic controls and suitable electrical insulation, is known as a Badu Jet and is available commercially from Recreonics Corp. of Indianapolis, Ind., for example. Electrical connection and/or pump pressure for the light and swim jet L/S is suitably applied as shown by line S in FIG. 4 from the pump/motor housing 58.

While the modular unit of the invention comprises essentially the prefabricated unit contained within the package 50, the module also may be equipped and supplied with a motor and pump shown as a single itme 44 and electrical controls and other accessories such as an automatic chlorinator 49.

Instrument and controls for the operation of the various functions of the modular unit may be located at a convenient location; such as shown by the panel box 66 which is equipped with suitable controls, elements and audio/visual indicators as shown on the panel leaf face 67. Such controls include, among others the on-off switch, high and low speed selector for a two-speed pump motor, light switch, heater control, visual indicator to show the condition of the filter, and the like.

Figure 4:
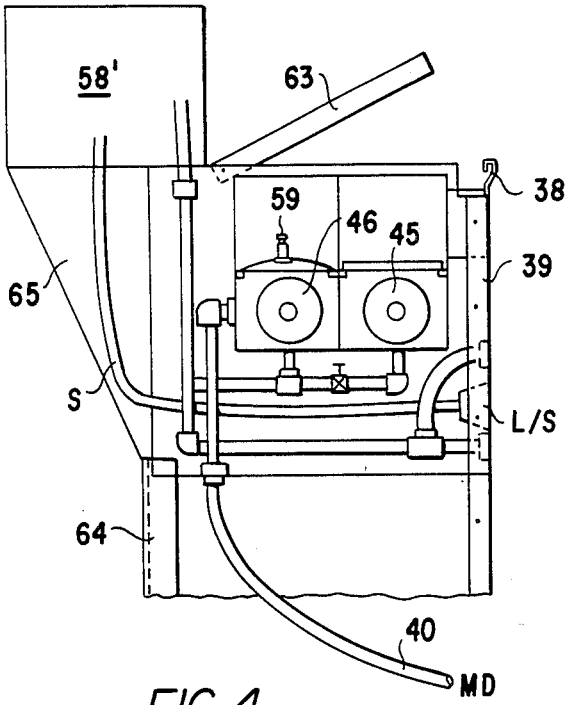
FIG. 4 is a schematic view illustrating generally in side elevation the swimming pool circulating and filtration modular unit of the invention relative to a swimming pool wall.

The modular unit, in schematic form, is further shown in FIG. 4 wherein the filter elements 45 and 46 within the package 50 are illustrated in side elevation. The modular unit is supported on one side by the pool wall segment 39 which is provided with side flanges that mate with like side flanges of the pool wall members and on the other side by the support legs, one of which 64 is shown. A pump/motor enclosure and support therefor are schematically shown at 58 and 65, respectively. Upon installation, the modular unit is designed so that the side 39 of the module 30 comprises a segment 39 (referred to in FIGS. 2, 3 and 4) of the pool vertical wall and a coping therefor which is shown at 38. Deck lid 63 for the modular unit is easily lifted (or removed) and may comprise a part of the pool deck surrounding the swimming pool.

Figure 5:
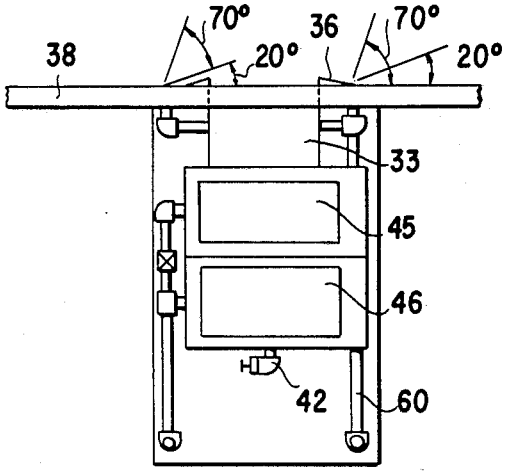
FIG. 5 is a schematic view illustrating generally in plan view the swimming pool modular unit of the invention again in relation to a segment of the swimming pool wall.

In FIG. 5 the directional flow of the filtered water returned to the swimming pool through returns 34 and 35, so as to provide maximum continuous complete circulation of all the water in the pool, is illustrated by a combination of means including streamlining the skimmer cover plate 36 to minimize friction drop, using a water return arrangement that directs the water into the swimming pool at an angle of about 20 to 70 degrees to the pool wall as illustrated in FIG. 5. The circulation of the system is enhanced by utilizing a filtration arrangement which is on the suction side rather than on the pressure side of the pump.

In operation of the filtration system of the invention, pool water will flow past the skimmer face plate 36 which is hydraulically constructed so as to provide low inlet losses and optimize inlet flow into the skimmer 33. The dirty pool water flows past the skimmer into the front compartment of the filter housing 50. The flow then goes through the skimmer filter 45 which removes dirt from the pool water. After leaving the skimmer filter 45 the water goes through a suitable throttle valve 43 which is used to vary the percentage of flow coming from the skimmer. The valve 43 can be adjusted to draw complete suction from the vacuum filter 46 to the exclusion of suction from filter 45.

Flow comes in through the main drain 32 which is located at the low point of the pool and collects dirt which settles at the pool bottom. The flow comes through main drain piping 40 through a main drain valve 42. The valve 42 can be throttled to draw a vacuum in the main drain filter housing 48. The main drain filter 46 as noted hereinabove is provided with a vacuum suction port 59 to allow for manual vacuuming of the pool.

After leaving the valve 42, the pool water to be filtered flows into the main drain filter housing 48 and is then filtered through the filter 46, where it is purified and particulate matter is removed. The cleaned water then flows through piping 52 where it joins the flow from the skimmer filter 45. The vacuum level in the suction line 52 may be suitably monitored. A vacuum switch 56 is connected in series with the pump 44 and the vacuum level actuates the switch 56 to open the circuit for pump 44 and cut power to the pump 44. Should the filters become blocked with dirt or particulates, the vacuum level in the suction line 52 will increase. If the vacuum level gets to the actuation point of the vacuum switch 56, the pump 44 will shut off. Additionally, the vacuum switch 56 may be actuated if the main drain 32 is blocked for any reason and the skimmer valve 43 is throttled or skimmer 33 is blocked. This would act as a safety device to prevent accidental drowning or entrapment of an individual caused by inordinate suction buildup if the main drain 32 would be blocked.

The suction line 52 is connected to the pump 44 with quick connect fittings C to allow easy intallation at the site, or facilitate servicing of the pump 44 on the modular unit 50.

Flow of the water proceeds from the suction piping 52 through the pump 44 to the discharge piping 41. The discharge line 41 is connected with quick connect fittings, one of which is shown at C, similar to the connection on the suction piping 52, to allow easy installtion at the site.

Figure 6:
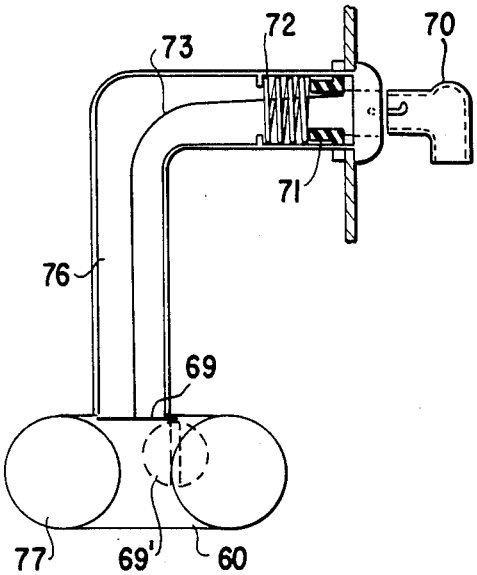
FIG. 6 is a diagrammatic illustration, partially in cross section, of a swimming pool sweep connection/actuating mechanism.

The invention also accommodates a pool sweep device. Flow of the filtered water through the discharge piping 41 and 60 is used to operate the device. As shown in FIG. 6, a pool sweep is actuated when the pool sweep connecting element 70 (FIG. 6) is engaged. When the elbow-like element 70 is inserted, it actuates a pusher block 71 against a return spring 72. The pusher 71 actuates a throttle lever 73 which diverts the flow control throttle from its position 60 into the return flow line 60, by valve, broken line at 69. This causes the flow in the system to drop and the pressure in the pool sweep conduit 76 to increase; the increased pressure functions to actuate the pool sweep. Pool sweeps are known devices that traverse the pool and loosen accumulated or settled debris which is then removed by filtration. A device of this kind is available commercially from Fox Pool Corporation of York, Pa., for example. When the pool sweep locking elbow 70 is disengaged, the spring 72 returns the lever pusher 71 which returns the lever 73 and removes the flow blocking lever 70. This removes the diverter 69 from the return flow line 60 and allows the system to operate at its normal relatively hig efficient flow operation.

The pool returns 34 and 35 used in discharging the filtered water to the pool can be of a standard design or may be of high efficiency kind that are designed to be hydraulically low in resistance to friction loss. The pool returns 34 and 35 may be situated at any location on the wall 39. Preferably for optimum performance, the returns 34 and 35 are located at a level of 10" to 25" below water level. A preferred flow pattern is obtained when the returns 34 and 35 are directed at an angle to the pool wall of 10° to 70° all in the same direction. However, servicable performance is also obtained when the flow from the respective returns is aimed in diametrically opposite directions.

It is thus seen that the modular unit of the invention is devised to be a prefabricated factory-built package with one face of the module package affording the capability of being an integral segment of the swimming pool wall. The prefabricated module is equipped with: a skimmer with an intake opening preferably having a streamline faceplate; a filter, preferably a dual compartment unit having a skimmer filter and a main drain filter; a skimmer throttle valve, and various additional necessary and optional accessories such as a main drain throttle valve; a quick connect coupler from filter to pump; automatic safety pump shutoff; hand held cleaner connector adaptor; light; automatic pool sweep pressure increase mechanism; chlorinator and the like.

Figure 7:
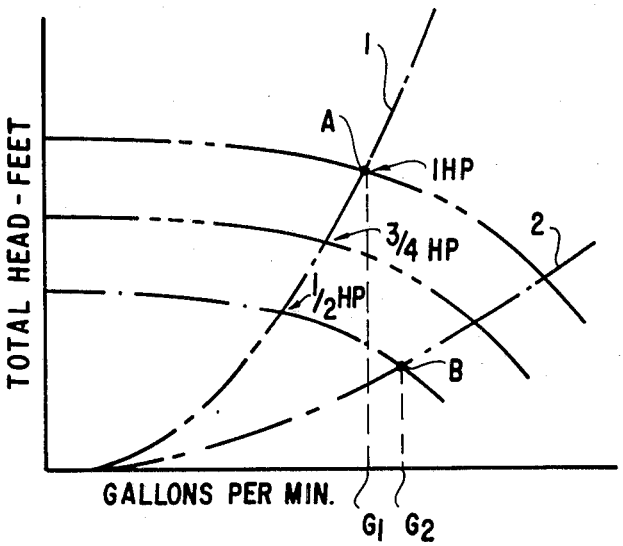
FIG. 7 is a graph illustrating the comparative function curves (pressure loss) of a typical prior art system (curve 1) with the usual plumbing around the swimming pool and the modular system (curve 2) of the invention.

Because of its arrangement and design, the modular filtration/circulation system of the invention has the advantage of a relatively low friction drop as depicted on FIG. 7, curve 2. This permits relatively greater flow than current conventional systems even when a smaller pump is used; and effects a substantial cost savings. Also, because of its efficiency, in order to achieve a given filtration effect, the pump may be operated for shorter periods of time. The relative reduction in friction loss in the system of the invention (curve 2) in comparison to the friction of a typical prior art system (curve 1) can be seen by reference to FIG. 7. As seen in FIG. 7, a typical prior art system which has a head curve 1 requires a one horsepower motor (Reference point A), due to its frictional losses, to be able to generate $G_1$ gallons per minute of water. The system of the invention, however, because of its substantially reduce friction losses has a head curve 2 which permits the use of a ½ horsepower motor (Reference point B) and still generate an even greater gallon per minute $G_2$ volume of water. Also, since the module is preplumbed and hydrostatically tested in a factory setting, installation time and requirements on the site are minimal; the field connections in the main require attaching the main drain, connecting the pump package to the filter package using quick connect couplers and plugging in the pump package into an outdoor electrical outlet. These relatively brief requirements avoid the relatively very extensive labor normally needed to dig trenches and install plumbing around the pool and results in a major cost savings. Because the skimmer is designed with a hydraulically streamlined inlet, it results in a low resistance of flow going into the skimmer. Further, although the unit is designed preferably to use a cartridge filter, alternatively, a sand or diatomacaous filter media may also be employed.

Reliability and effectiveness are futher enhanced by using, preferably, a filter housing divided into two compartments; in one compartment is a relatively high vacuum chamber and draws suction from the pool's main drain while the second chamber is primarily a non-vacuum chamber and draws from the skimmer. This two compartment design permits a longer filter cycle between cleaning. This can be achieved by utilizing the skimmer element function for the main drain filter function when the main drain element becomes blocked. By use of the two compartment arrangement, the filtration/circulation system of the invention will require relatively less servicing of the pump than a more typical system due to the fact that, in the latter systems, larger particles can get through to the pump and these particles destroy both the impeller and the mechanical seal. In the filtration, by the system of the invention, the suction side of the pump will allow only particles of a 20 micro size and less to get to the pump. These fine particles are far less detrimental to the pump and as a result will not cause a deterioration of the pump and parts. It will be understood, however, that the two compartment filtration system of the invention may also be adapted to function with a pressure filtration arrangement.

In the invention, the filtered water return outlets 34 and 35 are designed so that they may be permanently oriented with the pool wall so as to provide optimum water circulation for chemical mixing and water filtration. The return outlets are preferably disposed for optimum orientation at a depth of 10" to 25" from the water surface. Also the returns are arranged so as to produce optimum performance by directing the water flow in the same direction and preferably at an angle of 10° to 70° to the pool wall as illustrated in FIG. 5. It will be apparent that the system will also work with a return height less than 10" or more than 25" return(s); directions can also be at any angle. The returns of this system are preferably formed so as to provide a low resistance, producing a reduced system friction curve and lowering the horsepower required to operate the system. The system of course may also operate with standard high resistance returns.

As an important safety consideration, as noted hereinabove, the modular filtration/circulation system of the invention is provided with an automatic safety shutoff in which a vacuum switch connected to the vacuum side of the filter is activated when a predetermined vacuum is exceeded. For example, the switch would be set at a vacuum level of 10" to 30" Hg. If the filter becomes clogged, the vacuum switch would automatically cut the pump off and optionally trigger an audible and/or visible alarm. In addition, if the main drain were blocked by trash or physical being, the pump would also shut off, similarly signalling such occurrence.

The modular unit of the invention has the advantage of being readily adaptable to accommodate accessories notably, for example, the pool sweep accessory described hereinabove, automatic chlorinator, light, swim jet, and the like. In the case of the pool sweep, when the pool sweep is plugged in, it automatically reduces the flow in the system and increases the pressure so as to activate the pool sweep.

While a preferred embodiment of the invention has been described in detail and several modifications thereto have been indicated, it will be understood that the invention comprising a modular filtration/circulation arrangements for swimming pools affords a marked improvement in functional facilities of this kind and is not to be limited to the details provided except as they may be present in the appended claims.

What is claimed is:

1. A prefabricated swimming pool water filtration/circulation module comprising: means for containing essentially the entirety of the circulatory and filtration piping requirements for a swimming pool including ingress and egress conduits for connection with the interior of the swimming pool including modular housing having a side with an inlet to the module through which water skimmed from the water surface of a swimming pool is withdrawn, a conduit on the module for connection with a swimming pool main drain extending at side of the housing, a filter contained in said housing through which water drawn from the main drain and from said inlet is filtered, a return conduit in said housing side through which water withdrawn through said inlet and main drain is returned to the swimming pool at said housing side, pump means and actuator means for the pump to draw water water from the main drain and from the inlet and recirculate it to the return conduit, and an electrical connector for said actuating means.

2. The module of claim 1 wherein the pump means and actuator means therefor are combined with the module.

3. The module of claim 2 wherein the side of the mdoule comprises a segment of a swimming pool peripheral wall.

4. The module of claim 3 wherein the return conduit having an egress through the peripheral wall segment is disposed so as to direct return flow of filtered water at an angle of 20 to 70 degrees to the planar surface of the modular housing side for optimum water circulation.

5. The module of claim 2 wherein a pool cleaning mechanism is connected to the return conduit in conjunction with means to reduce flow of water therethrough and hereby increase pressure for the purpose of activating the pool cleaning mechanism.

6. The module of claim 2 wherein the pump means includes a motor and the motor is equipped with a cut-off switch from the vacuum side of the pump means to automatically deactivate the pump when the vacuum exceeds a predetermined level.

7. A prefabricated swimming pool skimming and filtration modular comprising: means for unit containing essentially the entirety of the circulatory and filtration piping requirements for a swimming pool including:

a housing for the unit wherein at least one side of the unit is substantially planar, said planar side formed to comprise a segment of the swimming pool peripheral wall, a skimmer opening in said planar side, a conduit means on said housing facing said planar side to connect thereto the main drain from the swimming pool, filter means in said housing to receive and filter water therethrough that is received from said skimmer and conduit connected to the main drain, pump means and a motor means for the pump to draw water to be filtered through said filter mounted on said housing, conduit means at said planar side for return discharge of water drawn through said filter means from said skimmer and main drain conduit, and an electrical connector for said motor.

8. The modular unit of claim 7 wherein the filter means comprises a first filter in a first housing for water drawn from the skimmer and a second filter in a second housing for water drawn through the conduit means connected to the main drain.

9. The modular unit of claim 8 including an automatic chlorinator feed on the vacuum side of sid pump means and an automatic pump cut-off when vacuum at the pump has reached a predetermined limit.

10. The dual compartment unit of claim 8 comprising attachment means on said first housing for attachment of a manual vacuuming device for the pool walls and bottom.

11. The modular unit of claim 7 equipped with interconnect means on the discharge side from said pump and motor means for receiving a pool cleaning mechanism accessory.

12. The modular unit of claim 7 equipped with an automatic chlorinator feed on the vacuum side of said pump means.

13. The modular unit of claim 7 wherein the pump means is connected to an automatic pump cut-off when the vacuum at the pump has reached a predetermined limit.

14. The modular unit of claim 13 wherein the pump means is a two-speed pump.

15. The modular unit of claim 7 in which the skimmer opening is equipped with a streamlined face plate to enhance nonturbulant water flow into the skimmer.

16. The modular unit of claim 7 including adjustable means to control the direction of flow of return discharge of water.

17. The modular unit of claim 7 wherein the pump and motor means comprise a variable speed means.

18. A prefabricated self-contained module comprising: means for drawing water therein from a swimming pool and for filtering and discharging the filtered water to the swimming pool, and containing essentially the entirety of the circulatory and filtration piping requirements for the swimming pool and including a two compartment filter, a first compartment to receive filter and discharge water from a swimming pool skimmer and a second compartment to receive filter and discharge water from a swimming pool main drain, means to divert the receiving means from a first filter compartment to the other compartment when the filter in a second compartment is clogged, a common conduit to receive water discharged from said first and second filter compartments, pump means to draw water through said two compartment filter, a motor to drive said pump, control means to inactivate said pump when vacuum drawing water to said filter exceeds a predetermined level, and means for readily connecting said module to a swimming pool.

19. The module of claim 18 wherein the pump means comprises a two speed unit and wherein the module contains an automatic chlorinator connected to the said common conduit.

* * * * *